US008967436B2

(12) United States Patent
Andersen et al.

(10) Patent No.: US 8,967,436 B2
(45) Date of Patent: Mar. 3, 2015

(54) DISPENSING SYSTEM

(75) Inventors: Daniel A. Andersen, Burlington, WI (US); Lance D. Chady, Franksville, WI (US); Jeffrey J. Christianson, Oak Creek, WI (US); Mark E. Johnson, Racine, WI (US); James R. Neilsen, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 566 days.

(21) Appl. No.: 13/206,453

(22) Filed: Aug. 9, 2011

(65) Prior Publication Data

US 2013/0037581 A1 Feb. 14, 2013

(51) Int. Cl.
*B65D 83/16* (2006.01)
*B65D 83/20* (2006.01)

(52) U.S. Cl.
CPC ..... *B65D 83/205* (2013.01); *B65D 83/206* (2013.01)
USPC ..... 222/402.13; 222/402.15

(58) Field of Classification Search
CPC ..... B65D 83/206; B65D 83/205
USPC ..... 222/402.13, 394, 153.1, 402.21, 182, 222/402.12, 402.15, 321.8
See application file for complete search history.

(56) References Cited

U.S. PATENT DOCUMENTS 3,169,672 A * 2/1965 Soffer et al. ..... 222/153.11
3,519,173 A 7/1970 Sagarin
3,651,993 A * 3/1972 Venus, Jr. ..... 222/153.02
3,768,707 A * 10/1973 Nigro ..... 222/402.13
3,913,805 A * 10/1975 Sette ..... 222/402.11
4,011,970 A * 3/1977 Crowle et al. ..... 222/321.8
4,166,554 A 9/1979 Anderson
4,219,135 A 8/1980 Ufferfilge
4,506,808 A * 3/1985 Goncalves ..... 222/182
5,234,132 A 8/1993 Bachand et al.
5,711,488 A 1/1998 Lund
5,839,616 A 11/1998 Irwin et al.
5,931,386 A 8/1999 Jouillat
D413,514 S 9/1999 Pericard et al.
6,145,704 A 11/2000 Geier
6,152,384 A 11/2000 Lopez et al.
6,260,738 B1 7/2001 Kerr et al.
6,283,333 B1 9/2001 Knickerbocker et al.
6,302,302 B1 10/2001 Albisetti
6,398,082 B2 6/2002 Clark et al.
6,523,722 B1 2/2003 Clark et al.
RE38,022 E 3/2003 De Laforcade
6,758,373 B2 7/2004 Jackson et al.
6,817,493 B1 11/2004 Parsons et al.

(Continued)

FOREIGN PATENT DOCUMENTS

EP 0693439 A1 1/1996
GB 1493031 A 11/1977
WO 2009152112 A1 12/2009

OTHER PUBLICATIONS

PCT/US2012/050071 International Search Report dated Dec. 3, 2012.

*Primary Examiner* — Kevin P Shaver
*Assistant Examiner* — Robert Nichols, II

(57) ABSTRACT

An actuator includes a conduit and first and second tabs protruding from the conduit. Each tab includes a first angled face and a first flat face disposed adjacent a first end of the tab and a second angled face and a second flat face disposed adjacent a second end of the tab.

18 Claims, 11 Drawing Sheets

(56) References Cited

U.S. PATENT DOCUMENTS

| | | | | |
|---|---|---|---|---|
| 6,820,823 | B2 | 11/2004 | Parsons et al. | |
| 6,832,700 | B2 | 12/2004 | Roberts et al. | |
| D507,487 | S | 7/2005 | Marroncles | |
| 6,981,616 | B2 | 1/2006 | Loghman-Adham et al. | |
| 7,004,359 | B2 | 2/2006 | Marroncles | |
| 7,036,691 | B2 | 5/2006 | Nicolas | |
| 7,104,427 | B2 | 9/2006 | Pericard et al. | |
| D536,969 | S | 2/2007 | Geier | |
| 7,204,393 | B2 | 4/2007 | Strand | |
| D580,265 | S | 11/2008 | Turchi | |
| 7,588,171 | B2 | 9/2009 | Reedy et al. | |
| 7,748,568 | B2 * | 7/2010 | Lasserre et al. | 222/135 |
| 7,775,408 | B2 | 8/2010 | Yamamoto et al. | |
| 7,784,650 | B2 | 8/2010 | Bates et al. | |
| 7,789,278 | B2 | 9/2010 | Ruiz de Gopegui et al. | |
| 7,854,356 | B2 | 12/2010 | Eberhardt | |
| 7,922,041 | B2 | 4/2011 | Gurrisi et al. | |
| 7,938,342 | B2 | 5/2011 | Octeau et al. | |
| 7,959,040 | B2 | 6/2011 | Heirman | |
| 2007/0290002 | A1 | 12/2007 | Schmitz et al. | |
| 2007/0290007 | A1 | 12/2007 | Eberhardt | |
| 2008/0164285 | A1 | 7/2008 | Hygema | |
| 2008/0210710 | A1 | 9/2008 | Marquardt et al. | |
| 2009/0014679 | A1 | 1/2009 | Hygema et al. | |
| 2009/0127293 | A1 | 5/2009 | De Laforcade | |
| 2009/0283609 | A1 | 11/2009 | Strand | |
| 2010/0264167 | A1 | 10/2010 | Strand et al. | |
| 2011/0108583 | A1 | 5/2011 | Sell et al. | |
| 2011/0132998 | A1 | 6/2011 | Marzio | |
| 2011/0233235 | A1 * | 9/2011 | Adams et al. | 222/402.13 |
| 2012/0012675 | A1 | 1/2012 | Lopez-Bonet | |
| 2013/0146611 | A1 * | 6/2013 | Sell | 222/1 |

* cited by examiner

DISPENSING SYSTEM

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to a dispensing system including an overcap with an actuator for placement on a container, and more particularly, to an actuator having at least one tab with a plurality of angled and flat surfaces for engagement with a flange extending from a sidewall of an overcap.

2. Description of the Background of the Invention

Aerosol containers are commonly used to store and dispense a product such as air freshening agents, deodorants, insecticides, germicides, decongestants, perfumes, or any other known products. The product is forced from the container through an aerosol valve by a hydrocarbon or non-hydrocarbon propellant. Typical aerosol containers comprise a body with an opening at a top end thereof. A mounting cup is crimped to the opening of the container to seal the top end of the body. The mounting cup is generally circular in geometry and may include an outer wall that extends upwardly from a base of the mounting cup adjacent the area of crimping. A pedestal also extends upwardly from a central portion of the base. A valve assembly includes a valve stem, a valve body, and a valve spring. The valve stem extends through the pedestal, wherein a distal end extends upwardly away from the pedestal and a proximal end is disposed within the valve body. The valve body is secured within an inner side of the mounting cup and a dip tube may be attached to the valve body. The dip tube extends downwardly into an interior of the body of the container. The distal end of the valve stem is axially depressed along a longitudinal axis thereof to open the valve assembly. In other containers, the valve stem is tilted or displaced in a direction transverse to the longitudinal axis to radially actuate the valve stem. When the valve assembly is opened, a pressure differential between the container interior and the atmosphere forces the contents of the container out through an orifice of the valve stem.

Aerosol containers frequently include an overcap that covers a top end of the container. Typical overcaps are releasably attached to the container by way of an outwardly protruding ridge, which circumscribes the interior lower edge of the overcap and interacts with a crimped seam that circumscribes a top portion of the container. When the overcap is placed onto the top portion of the container, downward pressure is applied to the overcap, which causes the ridge to ride over an outer edge of the seam and lock under a ledge defined by a lower surface of the seam.

In some systems, the overcap includes a dispensing orifice to allow product to escape therethrough. In such systems, an actuator typically interacts with the valve stem to release product into the actuator and out through the dispensing orifice of the overcap. Further, such actuators typically include an actuation mechanism, such as a button or trigger, that is integral with the actuator.

Numerous problems arise with prior art actuation systems during the manufacturing process. In particular, prior art actuators, such as actuator buttons, may be secured to the overcap via ultrasonic welding, interference fit, pin and socket, or other methods during manufacture. Such securement techniques do not allow the actuator button the freedom to flex during the actuation process when used by a consumer. The actuator buttons of such systems are typically secured to a front sidewall directly adjacent the dispensing orifice of the overcap. This rigid connection may lead to the actuator button breaking upon very little force being applied thereto. Also, anchoring the actuator button to the sidewall in such a manner ultimately causes fatigue in the actuator button, which may result in the breakage and/or distortion of the button or connection point.

A different problem associated with such prior art systems is that applying force to the actuator button to effectuate actuation oftentimes causes the actuator to misalign with the dispensing orifice, thereby causing product to be sprayed on internal portions of the overcap as opposed to through the dispensing orifice.

A further problem associated with such prior art systems occurs when the overcap is retained (or seated) onto the container during an assembly process. Given the varying manufacturing tolerances of the actuator and/or valve stem of the container, placement of the overcap on the container may force the actuator into an undesired operative position when first placed on the container. Misalignment leads to more overcaps being miscapped and/or breakage of the actuator. Such problems slow the manufacturing line during the assembly process, which results in lost profits to the manufacturer. Still further, during use, downward pressure exerted by a user on a button of the actuator may cause the actuator to become misaligned with the valve stem given varying manufacturing tolerances.

Therefore, a solution is provided herein that provides for a dispensing system that includes a container, an overcap, and an actuator at least partially disposed within the overcap. The actuator includes a plurality of angled and flat surfaces that are adapted to interact with channels disposed in flanges that extend from the overcap. The interaction between the angled and flat surfaces of the actuator and the channels of the flanges specifically provide the actuator with alignment capabilities before, during, and after actuation.

Further, the present disclosure provides novel ways to retain the actuator within the flanges of the overcap that require a more streamlined and cost effective manufacturing process.

Still further, allowing the overcap to flex and pivot during actuation extends the life of the actuator, while at the same time still retaining proper spray angles, preventing the actuator from being misaligned from the dispensing orifice, and preventing miscapping, breakage, or actuation during the manufacturing process.

SUMMARY OF THE INVENTION

According to one aspect of the invention, an actuator includes a conduit and first and second tabs protruding from the conduit. Each tab includes a first angled face and a first flat face disposed adjacent a first end of the tab and a second angled face and a second flat face disposed adjacent a second end of the tab.

According to a different aspect of the invention, an overcap for a container has a sidewall forming a chamber. A dispensing orifice is provided within the sidewall of the overcap. First and second flanges each have a channel formed therein. The first and second flanges extend from the sidewall. An actuator has first and second tabs protruding therefrom. Each tab includes a first and a second flat face and a first and a second angled face.

According to a further aspect of the present invention, an overcap for a container includes a sidewall having a dispensing orifice formed therein. An actuator has first and second tabs protruding therefrom. First and second flanges extend from the sidewall, wherein each flange has a channel formed therein. The first and second tabs are retained within the channels of the first and second flanges by first and second movable posts extending from the first and second flanges, respectively.

According to another aspect of the invention, a method of seating an overcap on a container includes the steps of providing a container with a valve stem and providing an overcap having a dispensing orifice and first and second flanges extending therefrom, wherein the flanges each include a channel disposed therein. Another step includes providing an actuator, which includes a conduit with an outlet orifice and a valve seat, wherein first and second tabs extend from the conduit, and wherein each tab includes two flat faces and two angled faces. The method further includes the step of positioning the first and second tabs within the first and second flanges, respectively, wherein the first and second flat faces of each tab substantially prevent clockwise rotational movement, thereby placing the outlet orifice of the conduit in substantial alignment with the dispensing orifice of the overcap. Another step of the method includes mating the overcap to the container, whereby the valve stem is seated within the valve seat of the conduit. Counter-clockwise rotational movement imparted to the conduit by the mating provides for the constrained movement of the first and second tabs by way of the first and second angled faces within the first and second flanges, respectively, thereby preventing substantial misalignment of the outlet orifice of the conduit with the dispensing orifice of the overcap.

DETAILED DESCRIPTION OF THE DRAWINGS

Figure 1:
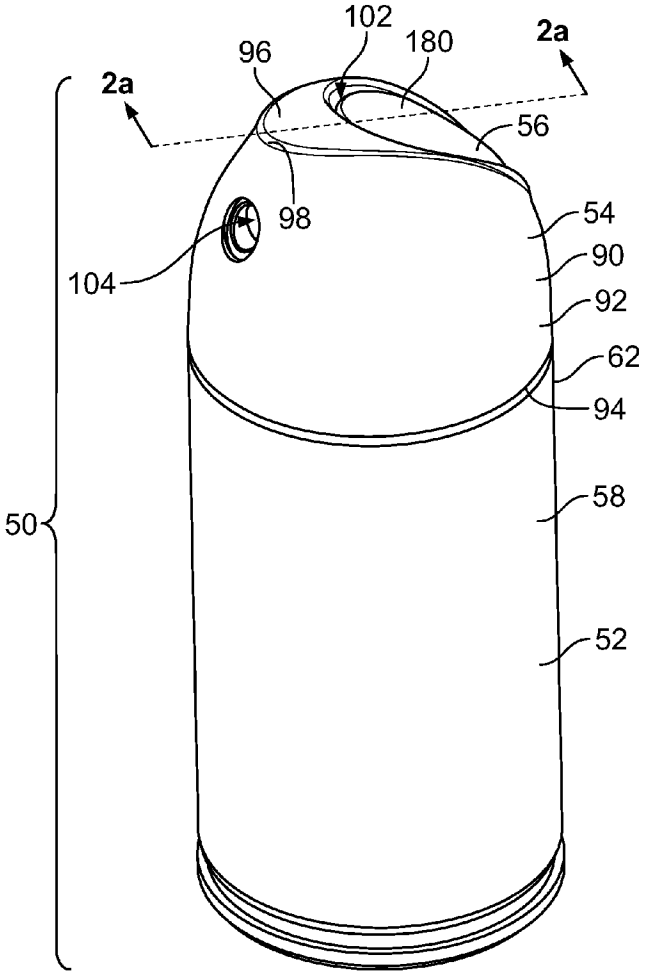
FIG. 1 is a front isometric view of a product dispensing system that includes a container and an overcap attached thereto.

FIG. 1 depicts a product dispensing system 50 that includes a container 52 and an overcap 54 disposed thereon. An actuator 56 is at least partially disposed within the overcap 54 and facilitates the product being dispensed from the dispensing system 50. In use, the product dispensing system 50 is adapted to release a product from the container 52 upon the occurrence of a particular condition, such as the manual activation of the overcap 54 by a user of the dispensing system 50. The product discharged may be a fragrance or insecticide disposed within a carrier liquid, a deodorizing liquid, or the like. The product may also comprise other actives, such as sanitizers, air fresheners, cleaners, odor eliminators, mold or mildew inhibitors, insect repellents, and/or the like, and/or that have aromatherapeutic properties. The product alternatively comprises any solid, liquid, or gas known to those skilled in the art that may be dispensed from a container. It is also contemplated that the container may contain any type of pressurized or non-pressurized product and/or mixtures thereof. The product dispensing system 50 is therefore adapted to dispense any number of different products.

Figure 2:
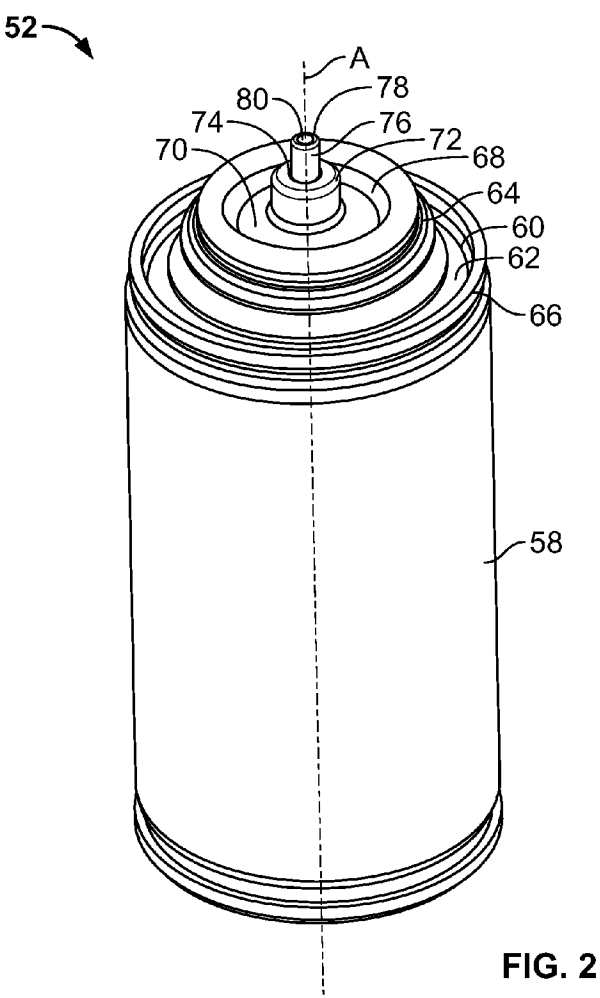
FIG. 2 is a front isometric view of the container of FIG. 1.

As best seen in FIG. 2, the container 52 comprises a substantially cylindrical body 58 with an opening 60 at a top end 62 thereof. A mounting cup 64 is crimped to a tapered portion of the container 52, which defines the opening 60. The mounting cup 64 seals the top end 62 of the body 58. A second crimped portion at a bottom end of the tapered portion defines a seam 66. The seam 66 and/or mounting cup 64 provide a location in which the overcap 54 may be attached thereto, as is known in the art.

Still referring to FIG. 2, the mounting cup 64 is generally circular-shaped and may include an annular wall 68 that protrudes upwardly from a base 70 of the mounting cup 64 adjacent the area of crimping. A central pedestal 72 extends upwardly from a central portion 74 of the base 70. A conventional valve assembly (not shown in detail) includes a valve stem 76, which is connected to a valve body (not shown) and a valve spring (not shown) disposed within the container 52. The valve stem 76 extends upwardly through the pedestal 72, wherein a distal end 78 extends upwardly away from the pedestal 72 and is adapted to interact with the actuator 56 disposed within the overcap 54. A longitudinal axis A extends through the valve stem 76.

Figure 2A:
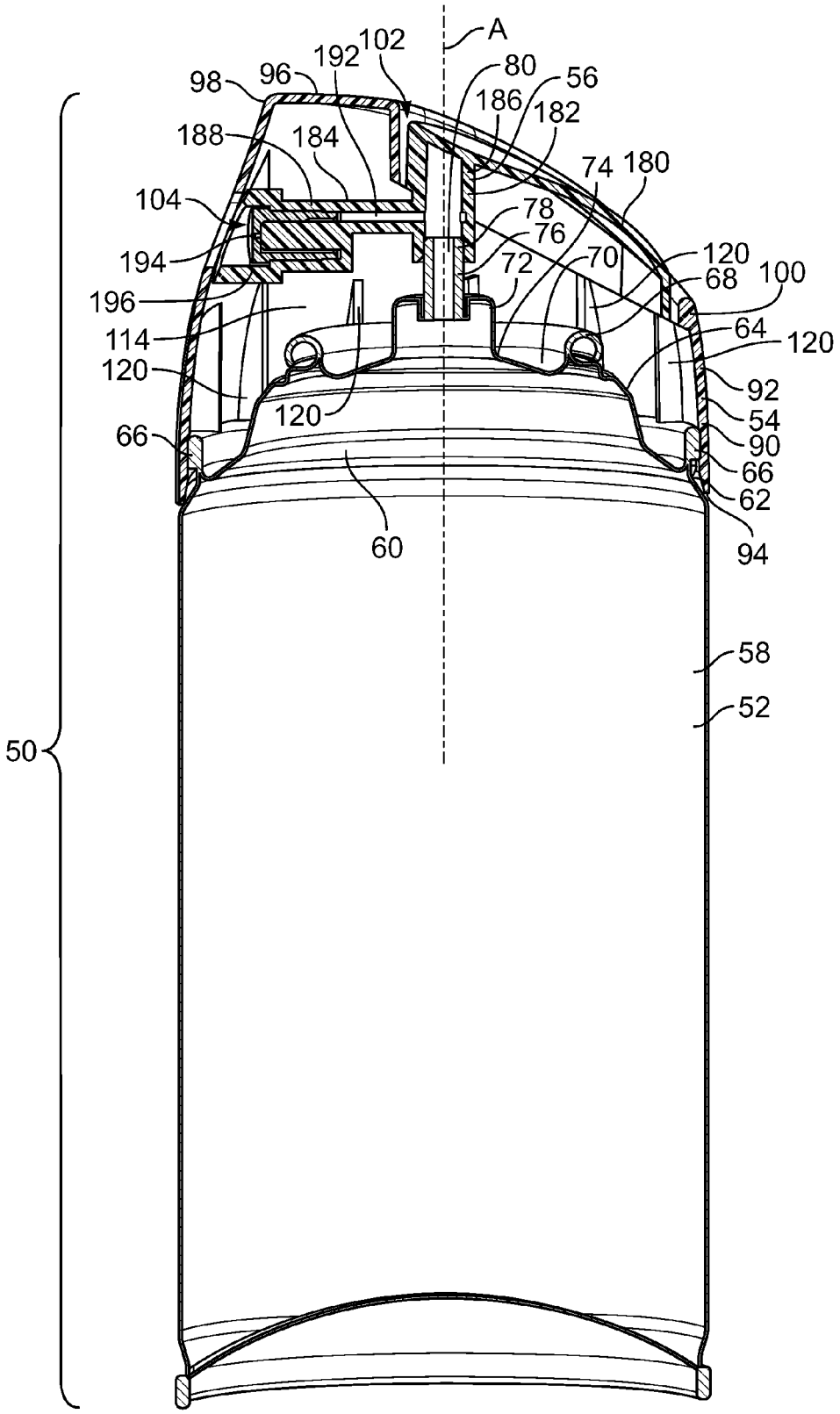
FIG. 2*a* is cross-sectional side view of the product dispensing system of FIG. 1 taken generally along the line 2*a*-2*a* shown in FIG. 1.
Figure 3:
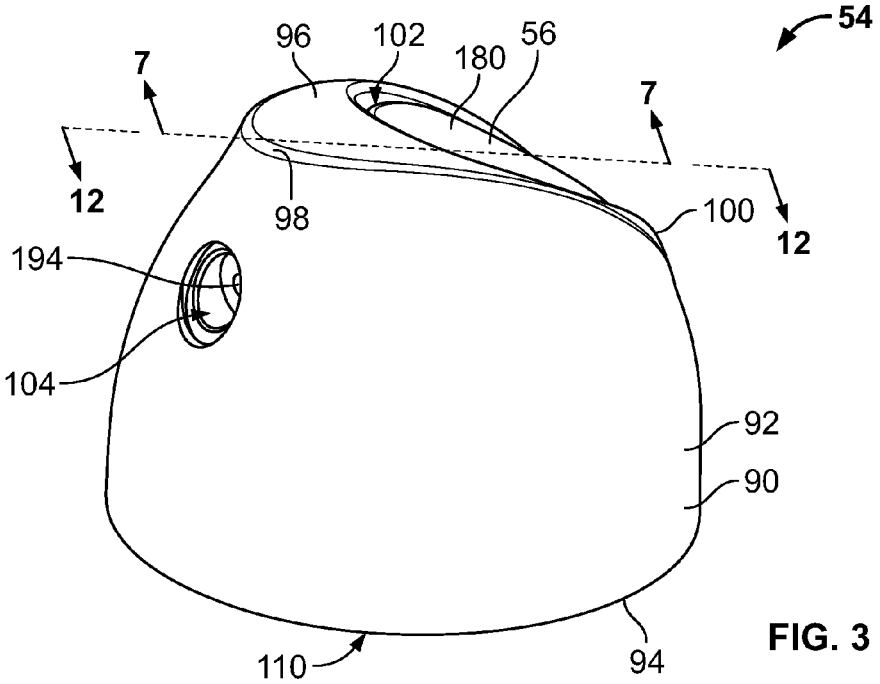
FIG. 3 is a front isometric view of the overcap of FIG. 1.

As best seen in FIG. 2*a*, prior to use, the actuator 56 is placed in fluid communication with the distal end 78 of the valve stem 76. A user may manually or automatically operate the actuator 56 to open the valve assembly, which causes a pressure differential between the container interior and the atmosphere to force the contents of the container 52 out through an orifice 80 of the valve stem 76, through the overcap 54, and into the atmosphere. While the present disclosure describes the applicants' invention with respect to the aerosol container 52, the present invention may be practiced with any type of container known to those skilled in the art.

Now turning to FIGS. 3-7, the overcap 54 is described with greater particularity. The overcap 54 includes a substantially cylindrical bulbous body 90 comprising a sidewall 92 that extends upwardly from a lower edge 94 and tapers inwardly toward a top wall 96. The top wall 96 slopes downwardly from a front edge 98 to a rear edge 100 thereof and includes an opening 102 (see FIG. 7) disposed therein. The opening 102 is adapted to receive portions of the actuator 56 as will be described in more detail hereinbelow. The overcap 54 further includes a dispensing orifice 104 disposed in the sidewall 92 adjacent the front edge 98 of the overcap 54, which allows the emission of product outwardly therethrough.

Figure 4:
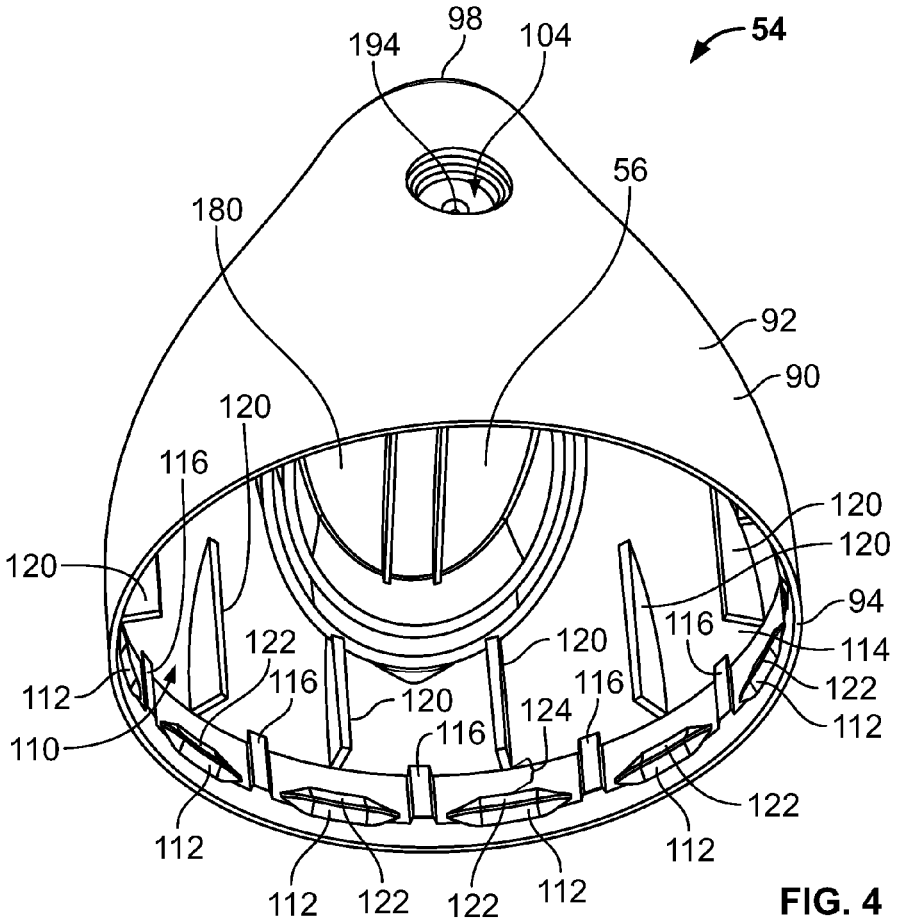
FIG. 4 is a bottom front isometric view of the overcap of FIG. 1.
Figure 5:
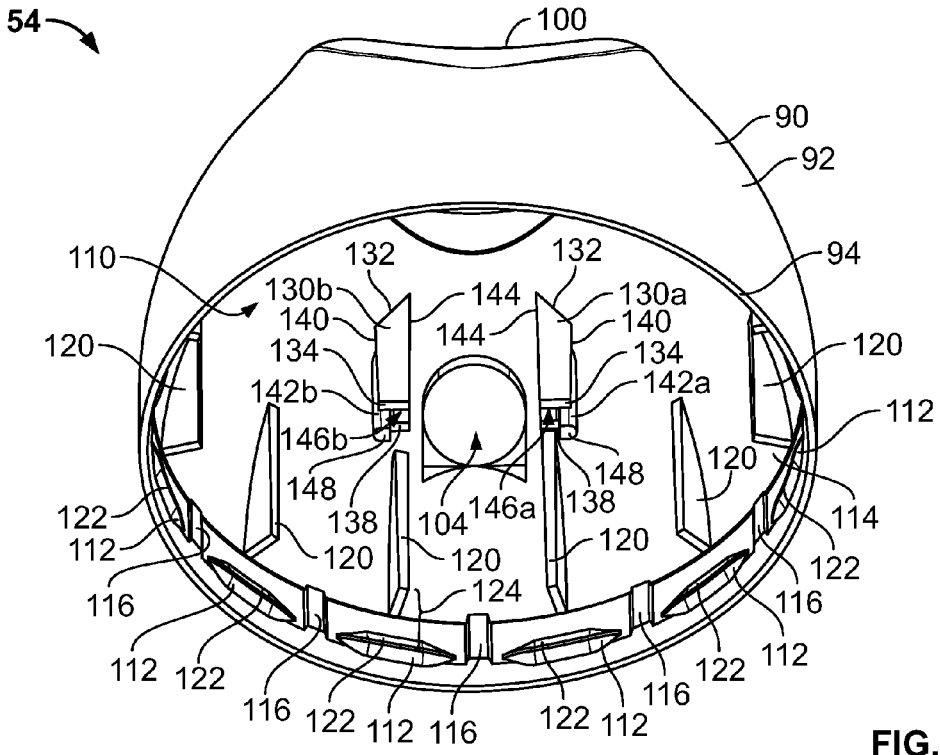
FIG. 5 is a bottom rear isometric view of the overcap of FIG. 1.
Figure 6:
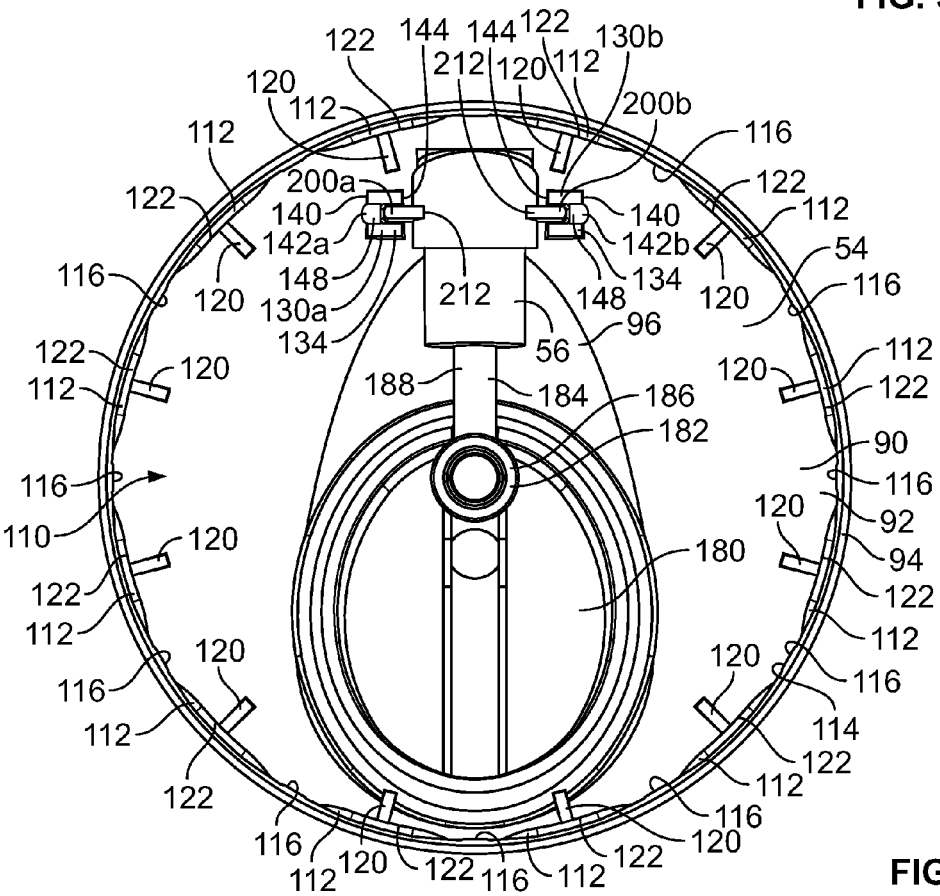
FIG. 6 is a bottom plan view of the overcap of FIG. 1.
Figure 7:
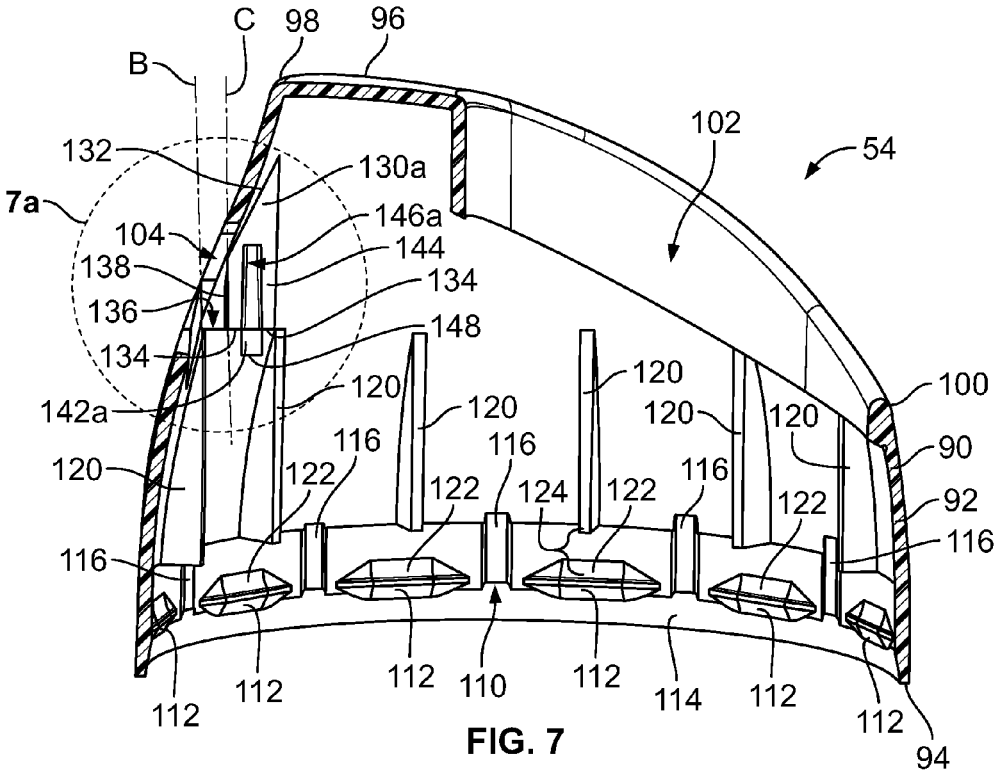
FIG. 7 is a cross-sectional view of the overcap of FIG. 1 taken generally along the line 7-7 shown in FIG. 3 without an actuator.

The overcap 54 further includes an opening 110 adjacent the lower edge 94 for receiving portions of the container 52. As best seen in FIGS. 4, 5, and 7, the overcap 54 includes a plurality of outwardly extending securement ribs 112 disposed around an interior surface 114 thereof. The securement ribs 112 are oriented in a manner substantially parallel with the lower edge 94. A plurality of rectilinear protrusions 116 are disposed between the securement ribs 112 and are adapted to allow for variances of different container sizes for use with the overcap. Specifically, the protrusions 116 relieve pressure on the sidewall of the overcap in the event that a container having a larger diameter (i.e., a diameter that is substantially similar to that of the overcap) is inserted into the overcap. In traditional systems, overcaps are unable to be mated with larger containers because of the limited flexibility of the overcap. Further, excessive outward stresses on these traditional overcaps may cause them to crack. Additionally, the alternating structure of securement rib 112/protrusion 116 allows for the overcap to be mated to a container having a smaller diameter. The securement rib 112/protrusion 116 setup provides enough interference action with the container to retain the overcap thereon.

The interior surface 114 of the sidewall 92 further includes a plurality of equidistantly spaced elongate secondary stabilizing ribs 120 that extend radially inwardly toward the center of overcap 54. The stabilizing ribs 120 are substantially parallel with one another and are provided above the securement ribs 112. In a preferred embodiment an equal number of ribs 112 and 120 are provided, wherein each stabilizing rib 120 is substantially aligned with a central portion 122 of a corresponding securement rib 112. As best seen in FIG. 2*a*, upon placement of the overcap 54 onto a container 52, the seam 66 thereof is fittingly retained within an annular gap 124 (see FIG. 5) provided between the securement ribs 112 and the stabilizing ribs 120 in a snap-fit type manner. Any number and size of ribs 112, 120 may be included that circumscribe the interior surface 114 of the overcap 54 to assist in attaching the overcap 54 to the container 52. Alternatively, other methods may be utilized to secure the overcap 54 to the container 52 as known in the art.

The stabilizing ribs 120 may also provide additional structural integrity to the overcap 54 for allowing increased toploads on the overcap 54. Specifically, bottom surfaces of the stabilizing ribs 120 interact with portions of the container 52 to assist in spreading forces exerted on upper portions of the overcap 54 about the container 52. Further, the stabilizing ribs 120 assist in aligning and positioning the overcap 54 in the proper position during and/or after the capping process. Such alignment assistance helps to ensure that the actuator 56 is positioned correctly onto the valve stem 76.

Figure 7A:
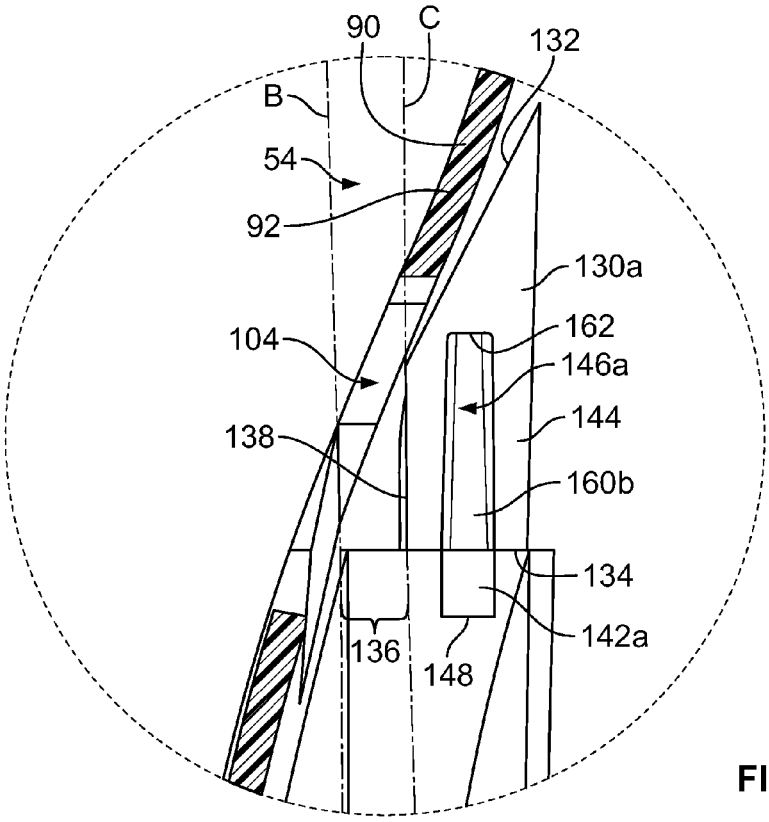
FIG. 7*a* is an enlarged, partial cross-sectional view of the overcap of FIG. 7, with some portions removed for the purpose of clarity.

As best seen in FIG. 5, two similarly shaped elongate flanges 130*a*, 130*b* extend downwardly from the interior surface 114 of the sidewall 92 of the overcap 54. The flanges 130*a*, 130*b* are attached to the sidewall 92 at a first end 132. A second end 134 of the flanges 130*a*, 130*b* is spaced from the sidewall 92. The first end 132 of the flanges 130 are connected to the sidewall 92 at a point adjacent the dispensing orifice 104 and extend downwardly in a manner substantially parallel with the stabilizing ribs 120. A gap 136 (see FIGS. 7 and 7*a*) is formed between a front edge 138 of each of the flanges 130*a*, 130*b* and the interior surface 114 of the sidewall 92. The gap 136 allows the flanges 130*a*, 130*b* to flex and act as a hinge during the actuation process, as opposed to the flanges 130 being secured to the overcap 54 along the length of the front edge 138. The width of the gap 136, as measured between an axis "B" and "C" that are parallel with one another, is preferably at least about 0.2 mm. In a particular embodiment, a preferred range of the gap 136 is between about 0.2 mm and about 10 mm, more preferably about 0.8 mm to about 3 mm, and most preferably about 1 mm. The axis "B" intersects the sidewall 92 and the axis "C" runs longitudinally parallel through the front edge 138 of the flanges 130*a*, 130*b*. The spacing of the gap 136 is specifically sized to allow the appropriate amount of flexing of the actuator 56 while still providing the guiding functions as discussed herein. The size of the gap 136 may be adjusted to an appropriate size such that the advantages described herein may be realized. Various manufacturing considerations may be taken into account such as the container size, the overcap size, the type of product being dispensed, the actuator size, the manufacturing materials of the components, and the like.

Still referring to FIG. 5, the flanges 130*a*, 130*b* are each defined by an outer sidewall 140 having movable posts 142*a*, 142*b* extending therefrom and an inner sidewall 144 having channels 146*a*, 146*b* formed therein, respectively. Distal ends 148 of the posts 142*a*, 142*b* extend downwardly past the second ends 134 of the flanges 130*a*, 130*b*. The distal ends 148 of the movable posts 142*a*, 142*b* are adapted to be folded over and at least partially cover a portion of the channels 146*a*, 146*b* accessible through the second ends 134 of the flanges 130*a*, 130*b*. In a different embodiment, the distal ends 148 of the movable posts 142*a*, 142*b* cover at least all of the portions of the channels 146*a*, 146*b* accessible through the second ends 134 of the flanges 130*a*, 130*b*. In some embodiments, the posts 142*a*, 142*b* are integral with the flanges 130*a*, 130*b*, whereas in other embodiments the posts 142*a*, 142*b* are separate structures attached to the flanges 130*a*, 130*b*. The posts 142*a*, 142*b* may be formed utilizing any process known to those of skill in the art, such as heat staking, cold forming, rolling over, swedging, or the like.

Figure 8:
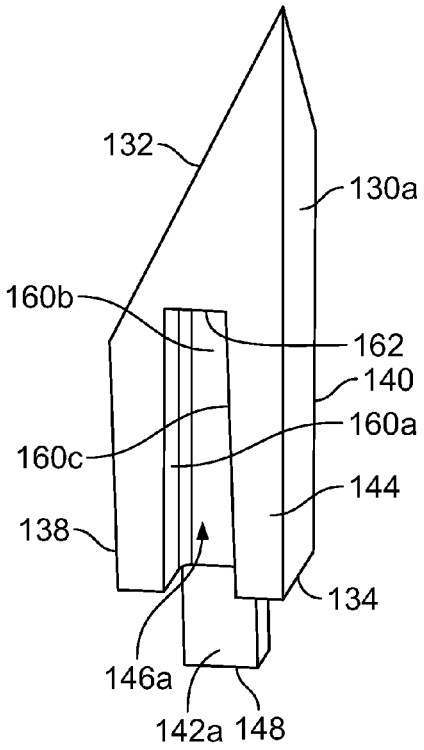
FIG. 8 is an enlarged isometric view of a flange depicted within the overcap of FIG. 7.

As best seen in FIGS. 7 and 8, each channel 146*a*, 146*b* is rectilinear and extends from a point adjacent the first end 132 of the flange 130*a*, 130*b* downwardly toward the second end 134 of the flange 130*a*, 130*b*. Referring to FIG. 8, the channels 146*a*, 146*b* are defined by interior surfaces 160*a*, 160*b*, 160*c* and an end wall 162. Prior to manufacturing, the channels 146*a*, 146*b* are open at the second end 134 to allow for the insertion of portions of the actuator 56. In the present embodiment, the interior surfaces 160*a-c* have a length dimension of between about 2 mm to about 10 mm and a width dimension of between about 0.5 mm to about 4 mm, and more preferably of between about 4 mm to about 8 mm and between about 0.75 mm to about 2 mm, respectively. Each of the channels 146*a*, 146*b* further includes a depth dimension of between about 0.2 mm to about 1 mm, and more preferably about 0.4 mm. In a different embodiment, the channels 146*a*, 146*b* comprise interior surfaces with varying cross-sections and sizes, which are adapted to interact with corresponding parts on the actuator 56. The channels 146 act as an alignment and guidance mechanism for the actuator 56 as will be described in greater detail hereinbelow.

Now turning to FIGS. 9-12, the actuator 56 is shown to include a button 180 disposed on a conduit 182 and an elongate body 184 extending therefrom. The button 180 is integral with the conduit 182 and the body 184. The button 180 includes a complementary shape to the opening 102 in the top wall 96 of the overcap 54 (see FIG. 3) and extends partially therethrough. The conduit 182 in the present embodiment comprises a vertical conduit 186, which is in fluid communication with the valve stem 76 of the container 52 at a first end thereof and attached to the button 180 at a second end thereof. The body 184 of the present embodiment comprises a horizontal conduit 188 that is in fluid communication with the vertical conduit 186 at a first end thereof. The vertical conduit 186 includes an inlet orifice 190 (see FIG. 12) that is sized to receive the valve stem 76 from the container 52. The inlet orifice 190 allows fluid to pass through a passageway 192 (see FIGS. 2*a* and 12) that extends through the conduits 186, 188 to an outlet orifice 194. A truncated cylindrical head 196 is disposed adjacent a second end of the horizontal conduit 188 and includes the outlet orifice 194 extending therethrough. Various components as known in the art may be optionally included in portions of the actuator 56 such as, for example, a swirl chamber, a nozzle insert, and the like.

Figure 9:
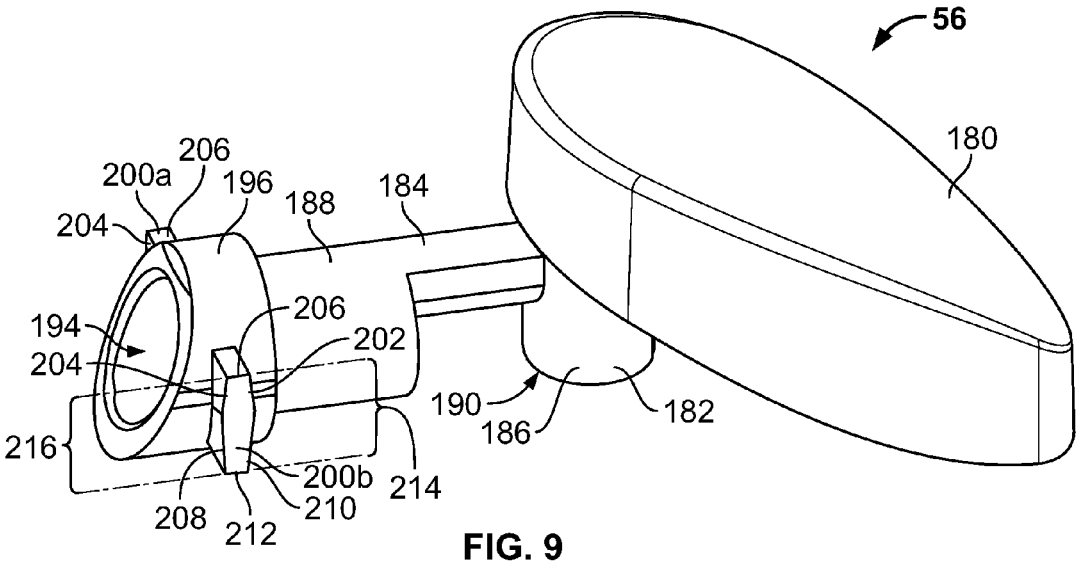
FIG. 9 is an isometric view of an actuator adapted to be used in the product dispensing system of FIG. 1.
Figure 10:
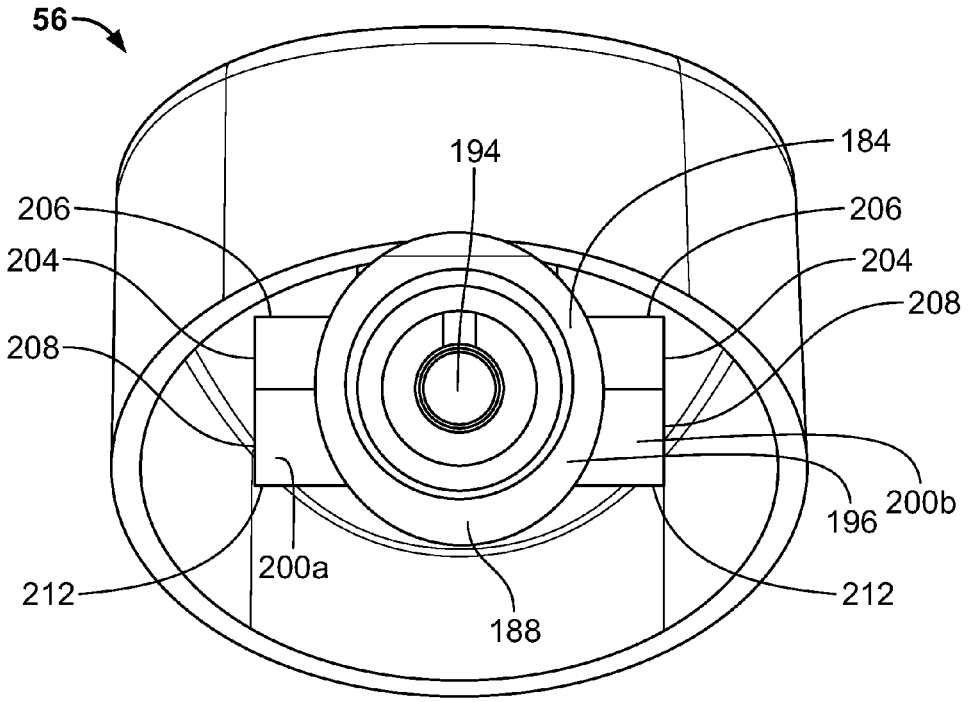
FIG. 10 is a front elevational view of the actuator of FIG. 9.
Figure 11:
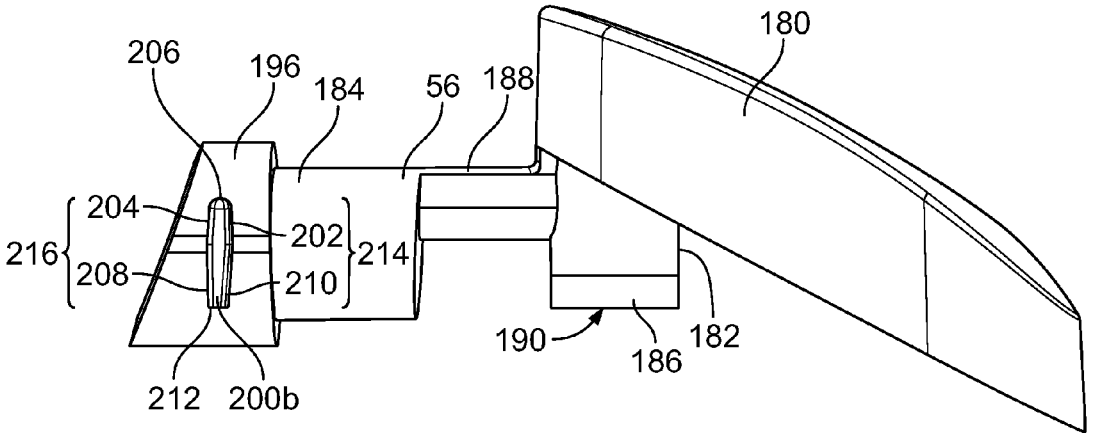
FIG. 11 is a side elevational view of the actuator of FIG. 9.
Figure 12:
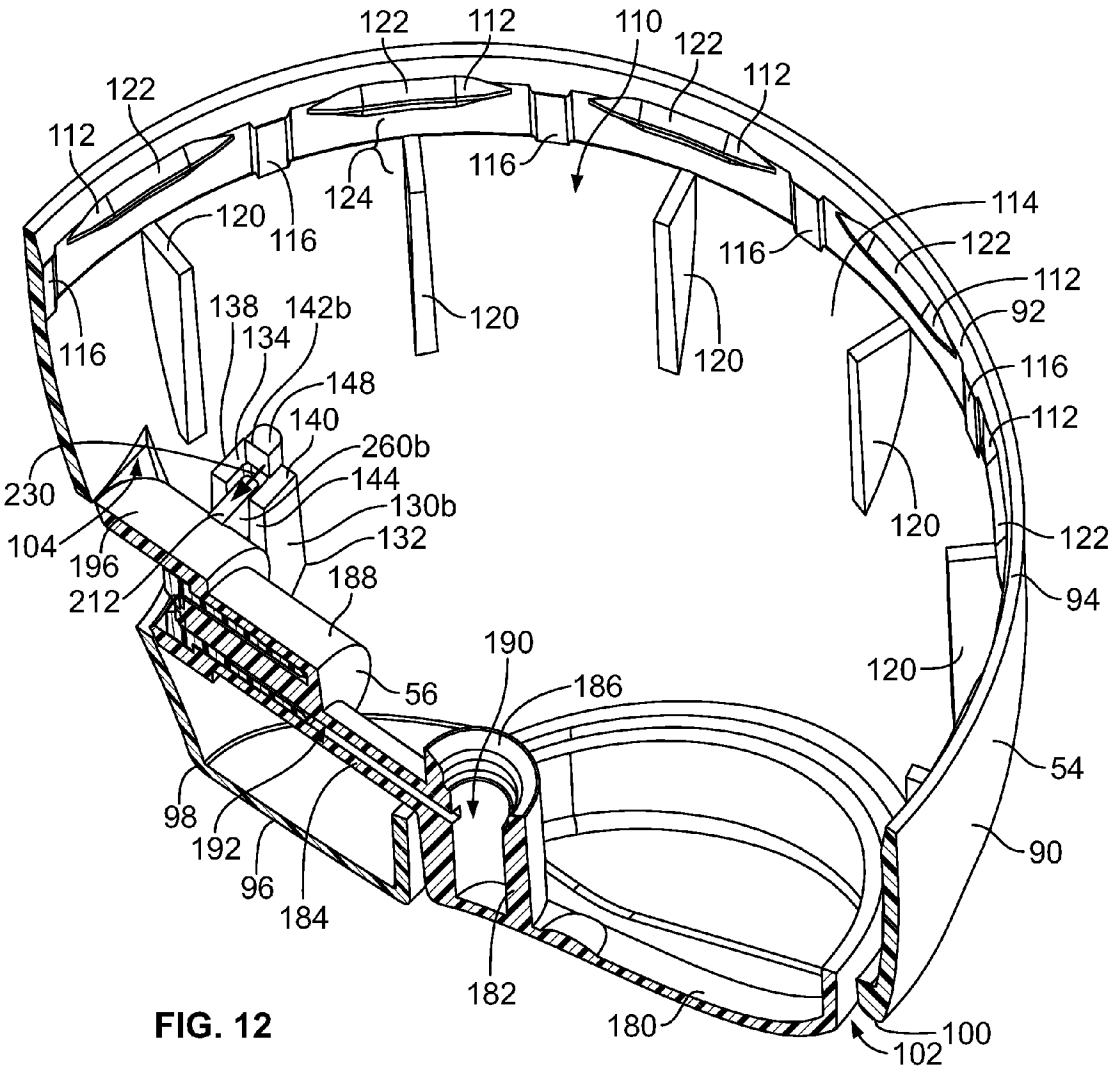
FIG. 12 is a cross-sectional view of the overcap of FIG. 3 taken along the line 12-12 thereof.
Figure 13:
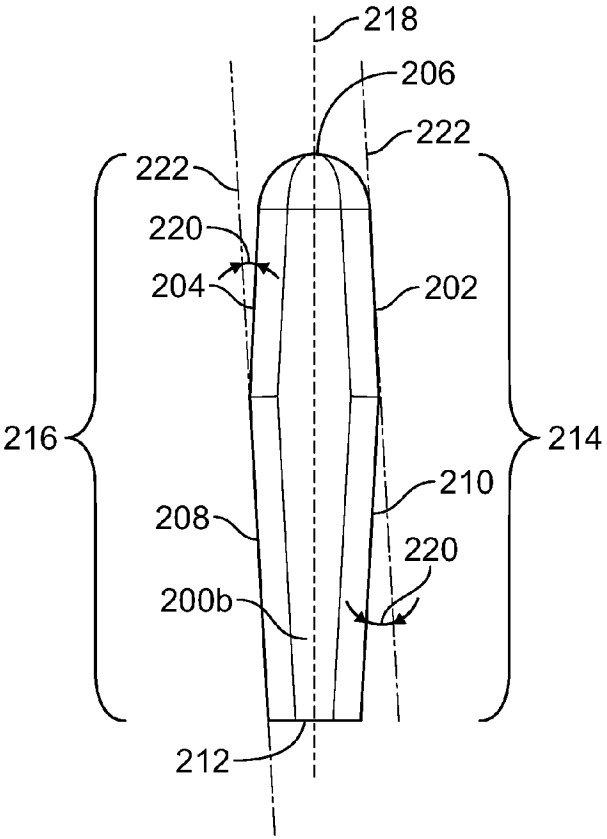
FIG. 13 is an enlarged side elevational view of a tab that extends outwardly from the actuator of FIG. 11.

As best seen in FIGS. 9, 11, and 13, two elongate tabs 200*a*, 200*b* protrude outwardly from the head 196 of the actuator 56 on opposing sides of the outlet orifice 194. The tabs 200*a*, 200*b* each include a first flat face 202 and a first angled face 204 disposed adjacent a first end 206 of the tabs 200*a*, 200*b*, and a second flat face 208 and a second angled face 210 disposed adjacent a second end 212 of the tabs 200*a*, 200*b*. The first end 206 of the tabs 200*a*, 200*b* each include a rounded edge that assists in centering the actuator 56 within the overcap 54 as will be described in more detail hereinbelow. The first and second flat faces 202, 208 extend in a substantially parallel manner with respect to an axis 218, which is defined by a center point of the tabs 200*a*, 200*b* (see FIG. 13). The first flat face 202 and the second angled face 210 are coextensive with each other and form a first side 214 of the tabs 200*a*, 200*b*. The first angled face 204 and the second flat face 208 are coextensive with each other and form a second side 216 of the tabs 200*a*, 200*b*. The second flat face 208 and the second angled face 210 have length dimensions that are greater than the corresponding length dimensions of the first flat face 202 and the first angled face 204, respectively. In a preferred embodiment, the second flat face 208 has a length dimension of between about 1 mm to about 4 mm and the second angled face 210 has a length dimension of between about 1 mm to about 4 mm. Further, the first flat face 202 preferably has a length dimension of between about 1 mm to about 4 mm and the first angled face 204 has a length dimension of between about 1 mm to about 4 mm. In the present embodiment, the first flat face 202 has a length dimension of about 2.0 mm, the first angled face 204 has a length dimension of about 2.0 mm, the second flat face 208 has a length dimension of about 3.0 mm, and the second angled face 210 has a length dimension of about 3.0 mm. It has been found advantageous to have a ratio of the lengths of the first flat and angled faces 202, 204 to the second flat and angled faces 208, 210 of between about 0.25:1 to about 1.5:1. In the present embodiment the ratio of lengths is about 2:3.

As depicted in FIG. 13, the first and second angled faces 204, 210 define an angle 220 with respect to axes 222, which are parallel with respect to the first and second flat faces 202, 208 of the tabs 200*a*, 200*b*. In a preferred embodiment, the angle between the axes 222 and the first or second angled faces 204, 210 is between about 2 degrees to about 10 degrees. In the present embodiment, the angle is about 5 degrees. The angles 220 for both the first and second angled faces 204, 210 are preferably the same with respect to each other. In a different embodiment, the angles 220 for the first and second angled faces 204, 210 are different with respect to one another.

To place the overcap 54 into an operable condition, the tabs 200*a*, 200*b* of the actuator 56 are slid or otherwise press fit into the channels 146*a*, 146*b* of the flanges 130*a*, 130*b* in the overcap 54. Once the tabs 200*a*, 200*b* are disposed within the channels 146*a*, 146*b*, the posts 142*a*, 142*b* are folded, staked, or otherwise formed inwardly (see arrow 230 of FIG. 12) over the second end 134 to cover the channels 146*a*, 146*b* and retain the actuator 56 therein. The posts 142*a*, 142*b* can be crimped to cover the channels 146*a*, 146*b* such that the actuator 56 is unable to be removed therefrom. The actuator 56 may be retained within the channels 146*a*, 146*b* in any number of ways including, for example, cold staking, heat staking, forming or rolling over the extended walls of the flanges 130*a*, 130*b*, and swedging. The posts 142*a*, 142*b* block a portion of the channels 146*a*, 146*b*, which provides important benefits during the manufacturing process. In particular, the actuator 56 is held within the overcap 54 during the manufacturing process and is retained therein throughout. The securement of the actuator 56 within the overcap 54 allows containers 52 to be mated to overcaps 54 and properly aligned during the assembly process, which reduces the possibility of misalignment and breakage of the actuator 56.

The assembled overcap 54 is thereafter seated and retained on the container 52 in a similar manner as noted above, i.e., ribs 112, 120 of the overcap 52 interact with the seam 66 of the container 52 to secure the overcap 54 to the container 52 in a snap-fit type manner. In this condition, the button 180 of the actuator 56 extends upwardly through the overcap 54 and out through the opening 102 disposed in the top wall 96 of the overcap 54. When seated properly, the button 180 extends up through the opening 102 to create a surface in which a user can apply pressure to effectuate the actuation process. Further, in this condition the valve stem 76 of the container 52 is seated within the inlet orifice 190, whereby surfaces defining the inlet orifice 190 and the conduit 186 provide a substantially fluid tight seal therebetween. The dimensions and placement of the valve stem 76, the ribs 112, 120 and the actuator 56, e.g., the inlet orifice 190, are critical in maintaining a proper fluid seal between the conduit 186 and the valve stem 76 and in preventing misalignment of the actuator 56, e.g, the outlet orifice 194 being misaligned with the dispensing orifice 104. In conventional overcap construction, varying manufacturing tolerances typically resulted in defective overcaps, wherein the alignment of the aforementioned components resulted in broken components, premature evacuation of the container, or improper spray angles. For example, if the valve stem in a conventional overcap was manufactured with a height component larger than the overcap was designed for, seating the overcap on the container may result in breaking the valve stem or actuator, accidental evacuation of the contents of the container, and/or the misalignment of the dispensing orifice to spray at an improper angle or within the overcap itself.

Various advantages are realized by the dispensing system 50 when the actuator 56 is inserted into the overcap 54 and retained therein. Specifically, surfaces defining the channels 146*a*, 146*b* of the flanges 130*a*, 130*b* are not attached to the overcap 54 in areas directly adjacent the second ends 134 thereof. This separation allows the channels 146*a*, 146*b* to flex, thereby allowing the outlet orifice 194 of the actuator 56 to be properly aligned within the dispensing orifice 104.

Another advantage is that the actuator 56 is retained in an upright manner in a non-actuation position, while still allowing for limited upward movement of the actuator 56 by way of rotational or pivoting movement of the tabs 200*a*, 200*b* within the channels 146*a*, 146*b* during and after the mating operation in which the overcap 54 is joined to the container 52. The allowance of limited upward travel by the actuator 56 allows for the overcap 54 to adjust for tolerance stack-ups and preload conditions without actuating during or after the mating operation. More specifically, when the overcap 54 is mated to the container 52, the rounded edge of the first end 206 of the tabs 200*a*, 200*b* helps guide the actuator 56 into the channels 146*a*, 146*b*. The first and second flat faces 202, 208 of each tab 200*a*, 200*b* substantially prevent clockwise rotational movement and keep the actuator 56 in an upright position (see FIG. 2*a*) by the interaction of the first and second flat faces 202, 208 with the interior surfaces 160*c*, 160*a*. Pressure applied to the button 180 causes the tabs 200*a*, 200*b* to reverse cam into the channels 146*a*, 146*b* to retain the actuator 56 therein. At the same time, the outlet orifice 194 of the conduit 188 is positioned in substantial alignment with the dispensing orifice 104 and the valve stem 76 is seated within the inlet orifice 190 of the vertical conduit 186. Any counter-clockwise rotational movement imparted to the conduit 186 by the seating, e.g., by a valve stem that is too large or an inlet orifice that extends too low, provides for the constrained movement of the first and second tabs 200*a*, 200*b* by way of the first and second angled faces 204, 212 impinging upon the interior surfaces 160*a*, 160*c* of the channels 146*a*, 146*b*. This constrained movement prevents substantial misalignment of the outlet orifice 194 of the horizontal conduit 188 with the dispensing orifice 104 of the overcap 54 and maintains a proper fluid seal between the inlet orifice 190 and the valve stem 76.

Figure 14:
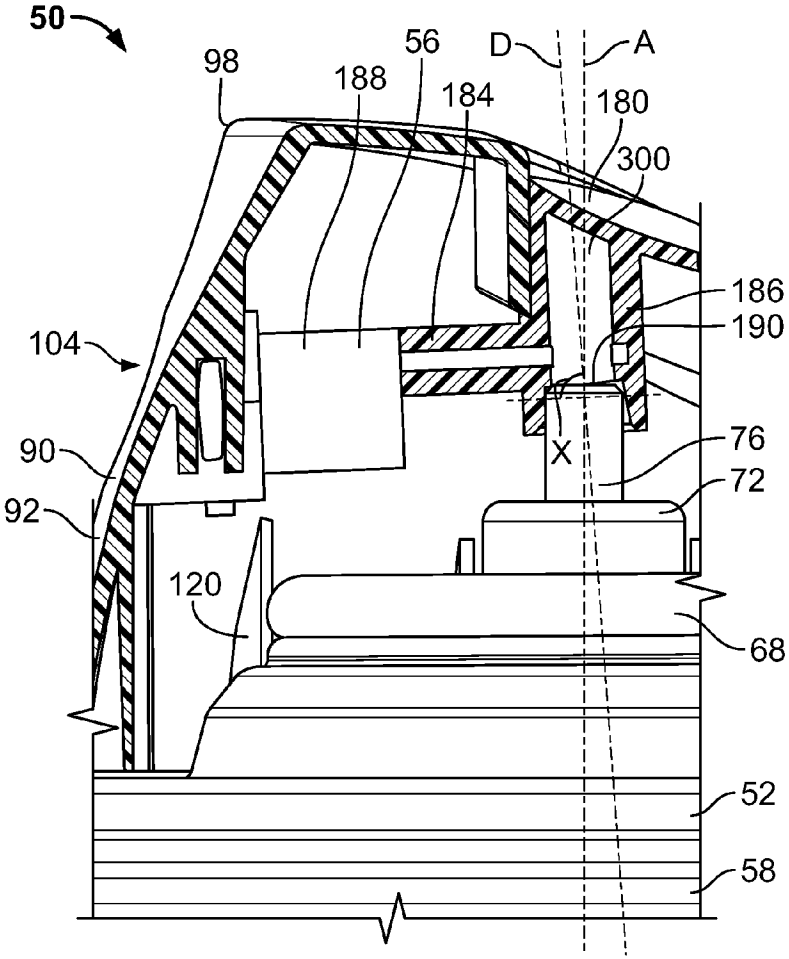
FIG. 14 is a partial cross-sectional view of the dispensing system of FIG. 1 in a first non-actuation state.
Figure 16:
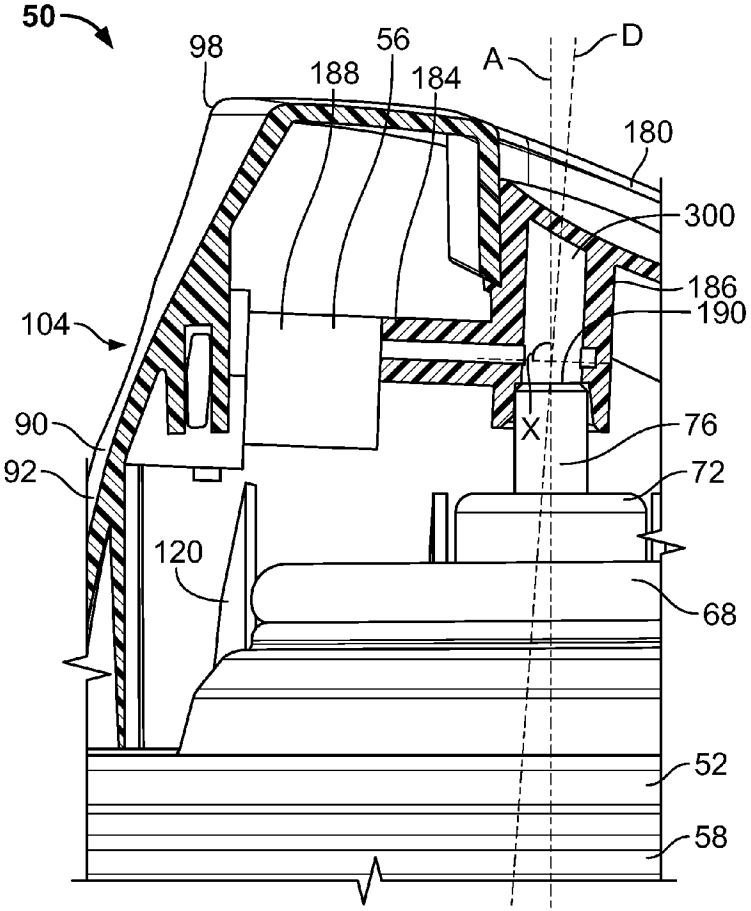
FIG. 16 a partial cross-sectional view of the dispensing system of FIG. 1 in a third actuation state.
Figure 15:
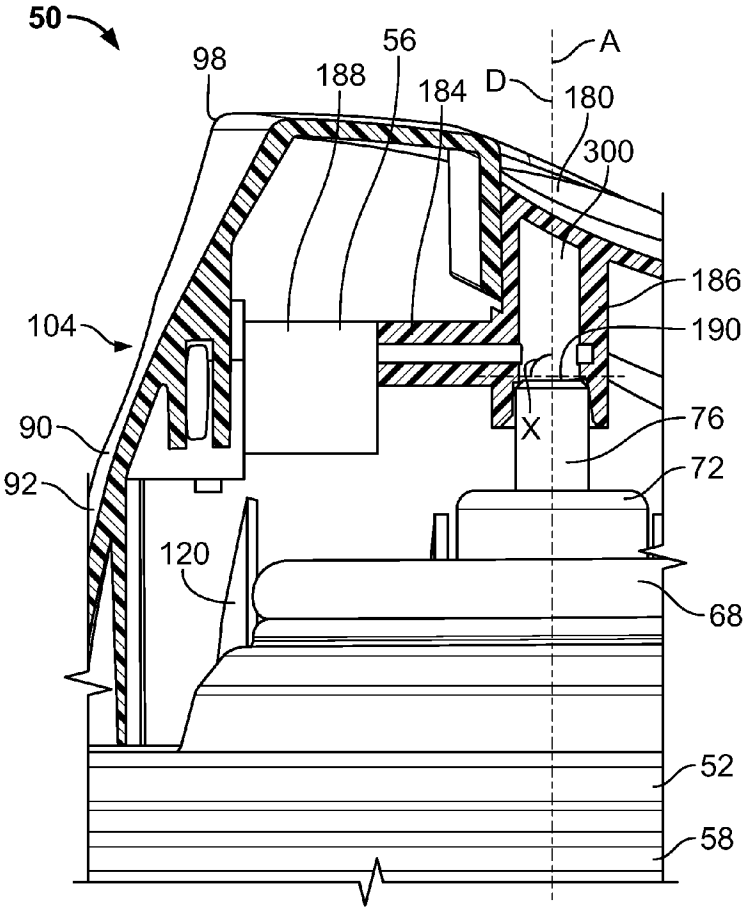
FIG. 15 is a partial cross-sectional view of the dispensing system of FIG. 1 in a second pre-actuation state.

With specific reference to FIGS. 14-16, the dispensing system 50 is shown in various pre-actuation states and an actuation state. As best seen in FIGS. 14 and 15, exerting a force on the actuator 56 of the dispensing system 50 pivots the actuator 56 from a first non-actuation state (FIG. 14) to a second pre-actuation state (FIG. 15). When in the second pre-actuation state, the inlet orifice 190 and the outlet orifice 194 of the actuator 56 are moved from a first position to a second position.

Still referring to FIGS. 14 and 15, the inlet orifice 190 pivots around the valve stem 76 between the first non-actuation state and second pre-actuation state. Further, in a particular embodiment, the outlet orifice 194 moves when the actuator 56 is transitioned from the first position to the second position. In this embodiment, it is preferred that the outlet orifice 194 be disposed in substantial alignment with a dispensing orifice 104 of the overcap 54 in the second position. In a different embodiment, the outlet orifice 194 is not transitioned into substantial alignment with the dispensing orifice 104 until the actuator 56 is in a third actuation state. A substantially fluid tight connection is maintained between the inlet orifice 194 and the valve stem 76 of the container 52 during the first non-actuation state, the second pre-actuation state, and the third actuation state.

Still referring to FIGS. 14-16, a particular embodiment is shown, wherein a longitudinal axis D is defined by a central axis of a channel 300 that extends through the vertical conduit 186. As best seen in FIG. 14, the axis D is offset from the axis A, which indicates that the actuator 56 is not in a substantially perfect vertical alignment with the channel 300 of the vertical conduit 186. As the actuator 56 pivots, the axis D is aligned with axis A at approximately a midpoint, or second pre-actuation state. Finally, in the third, actuating position, the axis D is offset from axis A on the opposing side of the axis A, which indicates the actuator 56 has fully pivoted into the actuating position.

As the actuator 56 pivots, the spray angle of the actuator 56 also changes. The spray angle x of the actuator 56 before actuation, in the first non-actuation position, is between about 90 degrees to about 100 degrees with respect to the longitudinal axis A (see FIG. 14). When the actuator 56 is transitioned to the second pre-actuation position the spray angle is between about 85 degrees to about 95 degrees with respect to the longitudinal axis A (see FIG. 15). In one embodiment, it is preferable that the spray angle not change when in the third actuation state, however, in other embodiments the aforementioned spray angle range for the second position may not be met until the actuator 56 is in the third actuation state or the spray angle may be even greater insofar as the outlet orifice 194 is in substantial alignment with the dispensing orifice 104 (see FIG. 16).

In use, the material is sprayed from the dispensing system 50 by exerting a force on the actuator 56. The force causes the actuator 56 to pivotally rotate so that the inlet orifice 190 is moved to a second pre-actuation position (see FIG. 15). In a preferred embodiment, the actuator 56 pivots between about 2 degrees to about 15 degrees from the first position to the second position. Thereafter, the actuator 56 undergoes flexure to move the inlet orifice 190 to a third actuation state and position (see FIG. 16), whereby material is dispensed therefrom. In the third actuation state, portions of the actuator 56 are elastically deformed to allow downward travel of the inlet orifice 190 for effecting proper impingement of the valve stem 76. In one embodiment, placement of the actuator 56 in the third position causes the actuator 56 to be offset from the longitudinal axis the same amount as in the second position. However, in other embodiments the actuator 56 is offset from the longitudinal axis between about 1 degree to about 20 degrees.

Upon removal of force from the actuator 56, the inlet orifice 190 returns to the first non-actuation position. The actuator 56 is moved to the first non-actuation position by one or more of the resilient nature of the actuator 56 and the force of the valve stem 76 moving upwardly by the valve spring to close the valve assembly within the container 52.

Figure 17:
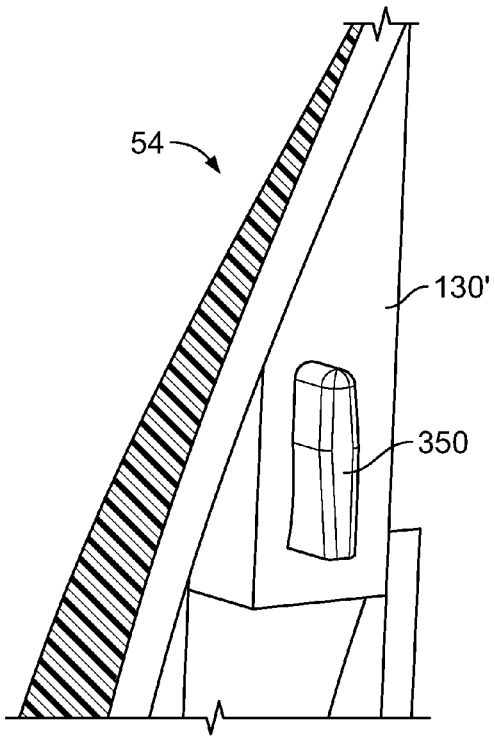
FIG. 17 is an enlarged, partial cross-sectional view of a different embodiment of an overcap, with some portions removed for the purpose of clarity.
Figure 18:
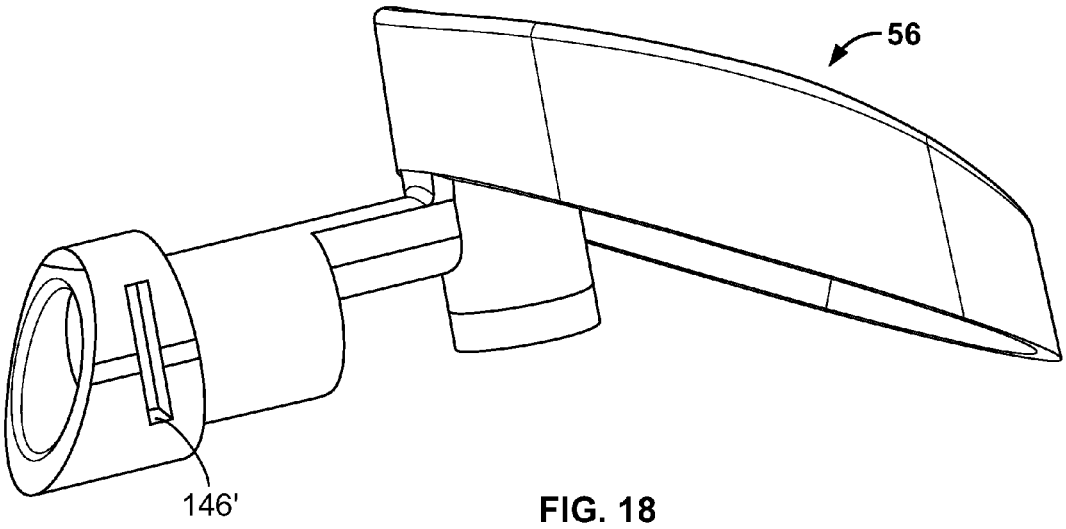
FIG. 18 is an isometric view of an actuator for use with the overcap of FIG. 17.

Now turning to FIGS. 17 and 18, a different embodiment of the dispensing system 50' is shown that includes an overcap 54' and an actuator 56' similar to the overcap 54 and actuator 56 described previously herein. In particular, the overcap 54 includes an elongate protrusion 350 that extends outwardly from the flange 130'. The protrusion 350 may include a plurality of flat and angled surfaces as described with respect to the previous embodiments. The actuator 56' includes a channel 146' and may optionally include a movable post (not shown). The function of the dispensing system 50' is similar to the dispensing system 50 described herein. Specifically, the protrusion 350 of the flange 130' is slid into the channel 146' disposed in the actuator 56' to retain the actuator 56' on the overcap 54'.

Any of the embodiments described herein may be modified to include any of the structures or methodologies disclosed in connection with different embodiments. Further, the present disclosure is not limited to aerosol containers of the type specifically shown. Still further, the overcaps of any of the embodiments disclosed herein may be modified to work with any type of aerosol or non-aerosol container.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. An actuator, comprising:

a conduit; and first and second tabs protruding from the conduit, wherein each tab includes a first angled face and a first flat face disposed adjacent a first end of the tab and a second angled face and a second flat face disposed adjacent a second end of the tab, the first and second tabs to be retained in respective channels, and wherein the first angled face is coextensive with the second flat face and the second angled face is coextensive with the first flat face.

2. The actuator of claim 1, wherein the conduit comprises a horizontal conduit fluidly connected to a vertical conduit, and wherein an outlet orifice is provided at an end of the horizontal conduit.

3. The actuator of claim 2, wherein the first and second tabs protrude outwardly from opposing sides of the horizontal conduit and are disposed adjacent the outlet orifice.

4. The actuator of claim 2, wherein the vertical conduit includes an opening at a first end that receives a valve stem of a container.

5. The actuator of claim 4, wherein the vertical conduit further includes a button extending from a second end that assists in actuating the valve stem when pressure is applied thereto.

6. The actuator of claim 1, wherein the first angled face is disposed adjacent the first flat face and the second angled face is disposed adjacent the second flat face.

7. The actuator of claim 1, wherein the length dimensions of the second flat face and the second angled face are greater than the length dimensions of the first flat face and the first angled face, respectively.

8. The actuator of claim 1, wherein the first and second flat faces assist in retaining the actuator in an upright position when the actuator is disposed within an overcap.

9. The actuator of claim 1, wherein the first and second tabs include an equal number of flat and angled faces with respect to each other.

10. An overcap for a container, comprising:

a sidewall forming a chamber;

a dispensing orifice within the sidewall of the overcap;

first and second flanges each having a channel formed therein, wherein the first and second flanges extend from the sidewall; and an actuator having first and second tabs protruding horizontally outward from opposing sides of the actuator and toward the sidewall, wherein each tab includes a first and a second flat face and a first and a second angled face, wherein the first and second flat faces are disposed in the channels and limit rotational movement of the actuator.

11. The overcap of claim 10, wherein the first and second flanges extend from the sidewall in a manner substantially parallel with a longitudinal axis of the sidewall.

12. The overcap of claim 10, wherein the first and second tabs are retained in the channels of the first and second flanges, respectively, when the actuator is disposed within the overcap.

13. The overcap of claim 10, wherein the first and second flanges extend outwardly from the sidewall on opposing sides of the dispensing orifice.

14. The overcap of claim 13, wherein each flange includes a movable post adapted to assist in retaining the first and second tabs within the channels.

15. The overcap of claim 10, wherein the flanges flex between a first, rest position, and a second, flexed position, during an actuating operation.

16. The overcap of claim 10, wherein the angled faces of the tabs allow upward movement of the actuator, and limit rotational movement of the actuator, during seating of the overcap on a container.

17. The overcap of claim 10, wherein a gap is provided between the sidewall and the first and second flanges.

18. An overcap for a container, comprising:

a sidewall forming a chamber;

a dispensing orifice within the sidewall of the overcap;

first and second flanges each having a channel formed therein, wherein the first and second flanges extend from the sidewall; and an actuator having first and second tabs protruding therefrom, wherein each tab includes a first and a second flat face and a first and a second angled face, wherein the first and second flat faces are disposed in the channels and limit rotational movement of the actuator, and wherein the angled faces of the tabs allow upward movement of the actuator, and limit rotational movement of the actuator, during seating of the overcap on a container.

* * * * *